United States Patent [19]

Heid et al.

[11] 4,073,616

[45] Feb. 14, 1978

[54] OXIDATIVE AFTER-TREATMENT OF MATERIALS DYED OR PRINTED WITH SULFUR OR VAT DYESTUFFS

[75] Inventors: Christian Heid; Johannes Polster, both of Frankfurt am Main, Germany

[73] Assignee: Cassella Farbwerke Mainkur Aktiengesellschaft, Frankfurt, Germany

[21] Appl. No.: 746,888

[22] Filed: Dec. 2, 1976

[30] Foreign Application Priority Data

Dec. 6, 1975 Germany ..... 2555046

[51] Int. Cl.[2] ..... C09B 9/00; D06P 1/22; D06P 1/30; C11D 7/54

[52] U.S. Cl. ..... 8/34; 8/37; 252/100; 252/102; 252/186

[58] Field of Search ..... 8/34, 37; 252/100, 102, 252/186

[56] References Cited

U.S. PATENT DOCUMENTS

| | | | |
|---|---|---|---|
| 2,067,930 | 1/1937 | Kern | 8/34 |
| 2,576,846 | 11/1951 | Mecco | 8/34 |
| 2,576,847 | 11/1951 | Mecco | 8/34 |
| 2,730,428 | 1/1956 | Linder | 252/186 |

FOREIGN PATENT DOCUMENTS

| | | |
|---|---|---|
| 1,199,538 | 7/1970 | United Kingdom. |

*Primary Examiner*—Joseph L. Schofer
*Assistant Examiner*—Maria S. Tungol
*Attorney, Agent, or Firm*—Connolly and Hutz

[57] ABSTRACT

Dyeing with sulfur or vat dyes is improved by using as oxidant for the oxidative after-treatment to bring out final dye shade and fastness,

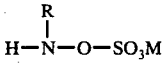

or a protonated product thereof
R being hydrogen or $—SO_3M$, and
M being hydrogen, ammonium or a compatible metal.

6 Claims, No Drawings

OXIDATIVE AFTER-TREATMENT OF MATERIALS DYED OR PRINTED WITH SULFUR OR VAT DYESTUFFS

The present invention relates to the oxidative after-treatment of fibers dyed or printed with sulfur dyes, vat dyes or sulfur-vat dyes. Such after-treatment is used to develop the final dye shade and to achieve good fastness properties.

Among the objects of the present invention is the provision of a novel oxidative after-treatment that is simple, rapid and extremely effective.

The foregoing as well as additional objects of the present invention will be more fully understood from the following description of several of its exemplifications.

According to the present invention very desirable oxidative after-treatment is effected at temperatures between about 20° and about 105° C, with an aqueous solution of a compound having the formula

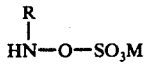

or a protonated product thereof,

R being hydrogen or $—SO_3M$, and

M being hydrogen, ammonium, or a compatible metal.

Ammonium standing for M includes protonated ammonia and protonated amines having a low vapor pressure and, consequently, a faint odor, e.g., triethanolamine. Compatible metals are the alkali and alkali earth metals.

Sulfur dyes are marketed in their water-insoluble fully oxidized form, or in their reduced, ready-to-dye, liquid form, or as water-insoluble substituted thiosulfuric acids. In the latter two forms the dyes do not have much affinity for the fiber to be dyed, and the fully oxidized form is converted by means of reducing agents such as sodium sulphide, sodium hydrogen sulphide or sodium dithionite, in an alkaline bath to their water-soluble reduced or leuco form which is substantive to and absorbed by the cellulose fibers during dyeing or printing.

After the dye has been absorbed by the fiber and the dyed fiber is rinsed, the dyeings or prints are oxidized in order to develop the final dye shade and fix the dye on the fiber.

Similar procedures are used with vat dyes where the stable oxidized form has a quinonoid structure and is hence water-insoluble, while the reduced form, that is to say the leuco form, has a hydroquinonoid structure and is soluble in an aqueous alkaline medium due to the phenolic OH groups which are then present. The leuco form of the vat dyestuffs is absorbed by the fiber and is then reoxidized on the fiber back to the water-insoluble quinonoid form.

Quinonimine dyes can also be considered vat dyes inasmuch as they are applied and after-treated in generally the same manner.

In the case of the sulfur dyes particularly, complete reoxidation is decisive for the proper shade and, above all, for the fastness properties, in particular for the fastness to wet processing and the fastness to rubbing, and is hence an important step of the total dyeing process. The customary oxidizing agents used are alkali metal bichromate/acetic acid, hydrogen peroxide, and peroxide compounds such as sodium perborate or sodium percarbonate. Oxidizing agents which have recently been proposed are alkali metal chlorite and alkali metal bromite, potassium iodate, sodium tetrathionate and ammonium persulphate. It is also customary to finish some dyeings only by rinsing, and in that case atmospheric oxygen acts as the oxidizing agent.

The oxidation with the foregoing chemicals has various disadvantages. Hydrogen peroxide and its derivatives markedly diminish the fastness to wet processing of the dyeings in most cases, in particular when used in an alkaline medium; while use of the peroxides in an acid medium, results in rather slow oxidation, duller shades, and danger of damage to the fiber, in particular in the case of dyeings with sulfur black. It appears that in this case the oxidation process does not stop at the disulphide stage but proceeds further to the formation of sulphonate groupings which make the dyestuff more readily soluble and cause the poorer fastness to wet processing. In other cases, especially with green dyeings using sulfur dyestuffs, the shade becomes substantially more bluish-tinged as the result of treatment with hydrogen peroxide or perborate. Although the fastness to washing in general does not deteriorate when bichromate or bichromate/copper sulphate are used as oxidant, a considerable dulling of the shade does take place. Also chromium atoms tend to become incorporated in the dye molecule, chelates being formed, and the dyed fiber then hardens or becomes brittle, and this can lead to losses of strength and to difficulties in the further processing and use of the dyed material. Oxidation with bichromate additionally tends to render the dyed materials hydrophobic, and the contaminating of washings with toxic chromium-IV compounds poses an environmental problem subject to government regulations.

Oxidation by atmospheric oxygen, as by means of "hanging" or correspondingly thorough rinsing processes, proceeds relatively slowly or is associated with a high consumption of water and, above all, is usually incomplete in the case of sulfur dyestuffs. As a result gradual after-oxidation takes place and this leads, in the course of from hours to several weeks, to a color "shift," that is to say a change of shade, clarity and also depth of the dyeing. Furthermore, there is the danger that the dye remaining in the reduced state will migrate during drying to produce uneven dyeings.

Sodium chlorite has the disadvantage that, in the acid region, it oxidizes the dyeings to the point of reducing their intensity, while on the other hand its oxidation effect is sluggish in a medium buffered with alkali and thus only occurs close to the boil at relatively high sodium chlorite concentrations.

Sodium bromite and potassium bromite have the disadvantage that the fastness properties of the dyeings to wet processing are noticeably inferior to those of dyeings which have been oxidized with bichromate.

Sodium iodate and potassium iodate give good oxidation effects but are expensive and call for precise control of the pH and the temperature.

The oxidants of the present invention avoid the foregoing disadvantages. These oxidants include hydroxylamine-O-sulphonic acid

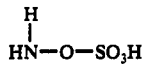

and hydroxylamine-O,N-bis-sulphonic acid

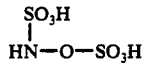

and the ammonium, alkali metal and alkaline earth metal salts thereof, the sodium or potassium salts being preferred.

The nitrogen atoms can be protonated by strong acids, such as, for example, sulphuric acid to form the corresponding hydroxylammonium compounds

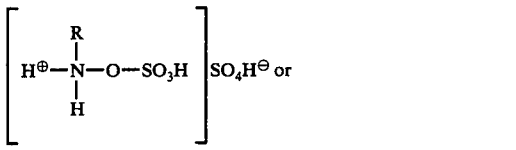

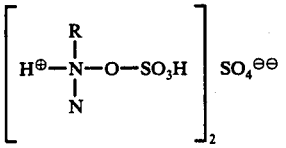

which are likewise suitable for the use according to the present invention. The anions of other strong acids, such as, for example, $Cl^-$, $NO_3^-$ or $H_2PO_4^-$, can replace the bisulphate ion or sulphate ion.

The after-treatment process according to the present invention is readily conducted on the fibers which have been dyed and rinsed, and may have been partially dehydrated by suction, squeezing off or centrifuging. They are after-treated at temperatures between 20° and 105° C with an aqueous solution which contains 0.5 – 10.0% by weight, relative to the weight of the dyed fibers, of an oxidant of the present invention. The pH value of the after-treatment liquor can be varied within wide limits, and the process is advantageously carried out in the range between pH 1 and pH 12, preferably at a pH between about 2 to about 10. The treatment of the dyed fibers can take place continuously or discontinuously on the industrial equipment which is customary for treatment methods of this type and in which the goods are kept in motion in the after-treatment liquor or the after-treatment liquor flows through the goods. Thus, for example, the treatment can be carried out by agitation of the goods in a solution of the oxidizing agents according to the invention, duration of the treatment of from 1 to 20, preferably about 5 to about 10, minutes being generally suitable. However, the after-treatment can also be carried out by impregnating the dyeings or prints with the after-treatment liquor, for example by immersion, then squeezing off of the immersed goods to liquor pick-up of 5 to 150%, preferably 20 to 100%, and subsequently steaming with normal steam at 100° to 105° C for 5 to 6 seconds, preferably for 20 to 40 seconds. Instead of steaming, the treatment can also conveniently take place in washing compartments at 40° to 90° C. In the case of dyeings and prints with sulfur dyes, the generally practiced treatment with detergent substances after the oxidation, can be dispensed with.

The after-treatment process of the present invention can be used for dyeings and prints of all sulfur dyes, sulfurvat dyes and vat dyes. Examples of desirable sulfur dyes are: C.I. Sulphur Yellow 4, C.I. Sulphur Yellow 2, C.I. Sulphur Brown 16, C.I. Sulphur Blue 10, C.I. Sulphur Blue 15, C.I. Sulphur Blue 11, C.I. Sulphur Blue 1, 3, 5 and 4, C.I. Sulphur Black 8, C.I. Sulphur Blue 7, C.I. Sulphur Yellow 9, C.I. Sulphur Red 3, C.I. Sulphur Green 5, C.I. Sulphur Brown 46, C.I. Sulphur Brown 10, C.I. Sulphur Brown 51, C.I. Sulphur Brown 5, C.I. Sulphur Red 7, C.I. Sulphur Green 2 and C.I. Sulphur Green 3.

Examples of desirable sulfur vat dyes and vat dyes are: C.I. Vat Yellow 33, C.I. Vat Violet 17, C.I. Vat Green 33, C.I. Vat Blue 38, C.I. Vat Green 4, C.I. Vat Blue 25, C.I. Vat Red 14, C.I. Vat Red 15, C.I. Vat Red 6, C.I. Vat Violet 3 and C.I. Vat Blue 43.

The sulfur dyes, when oxidized by the process according to the present invention, can also be in the form of water-soluble reaction products with sodium sulphite, which products contain thiosulphuric acid groups, or in the form of dispersible sulfur dyes prepared by incipient reduction with sodium sulphide.

The oxidizing agents of the present invention are known per se, Hydroxylamine-O-sulfonic acid of the formula $NH_2—O—SO_3H$ can be prepared by reacting hydroxylamine sulfate $(NH_3OH)_2SO_4$ with fuming sulfuric acid (Z. anorg. Ch. 302 (1959) p. 211–220) or with chlorosulfonic acid $HSO_3Cl$ (Z. anorg. Ch. 147 (1925) p. 142–155) or by reacting dry $NH_3$ with fuming sulfuric acid (J. Amer. Soc. 61 (1939) p. 1083–1086).

Hydroxylamine-O,N-bis-sulfonic acid of the formula

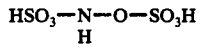

is prepared in the form of its potassium salt by acid treatment of potassium-hydroxylamine-trisulfonate (Raschig, Ber. dtsch. Chem. Ges. 39, (1906) p. 246 and 56 (1923) p. 208 as well as Haga, J. Chem. Soc. 89 (1906) p. 243) which in turn is obtained according to Divers and Haga (J. chem. Soc. 65 (1894) p.529 and J. chem. Soc. 85 (1904) p. 84) by introducing $SO_2$ into an aqueous solution of sodiumnitrite and sodiumcarbonate, isolating the sodium hydroxyl amine-N,N-disulfonate, oxidizing the latter with $PbO_2$ in the presence of sodium hydroxide and subsequent addition of KCl.

The oxidizing agents of the present invention have the advantage that they provide high oxidation rates, yet they produce an even oxidation with no significant deterioration of the fastness properties even when an excess amount of oxidant is metered in. The efficacy of these oxidizing agents is largely independent of the pH value. The dyeings which have been after-oxidized according to the present invention have high fastness to wet processing, even if more severe process conditions are used, such as for example an increased concentration of the oxidizing agent or a higher operating temperature, and they have a clear shade which is not dulled. Deterioration of the handle of the goods, its suppleness and wettability, is avoided, and damage to the fiber, which is a very serious matter especially when after-treating dyeings with sulfur black, is also avoided. The illustrative examples which follow give more details of the process of the present invention.

EXAMPLE 1

A woven all-cotton fabric is dyed, by the pad-steam method, in a dye liquor containing 60 g/l of C.I. Solubilized Sulphur Yellow 5, 15 g/l of calcined sodium carbonate, 12.6 g/l of sodium bisulphide (100% strength) and 1 g/l of an alkylarylsulphonate anionic wetting agent. The fabric is impregnated with the liquor at about 20° C, squeezed off (padded) and then subjected to a treatment with saturated steam at about 105° C for a period of 45 seconds. The fabric is then rinsed with cold water, again squeezed off, then immersed in an aqueous solution of 2% of hydroxylamine-O-sulphonic acid or in an aqueous solution of 2% hydroxylamine-O-sulfonic acid and 8% sodium carbonate at 90° C for 2 minutes, following which it is rinsed with hot then cold water and dried.

A clear shade and better fastness properties to wet processing are achieved than in the case of other customary oxidizing agents.

EXAMPLE 2

In a dyeing apparatus for yarn in hank form, cotton yarn which is ready for dyeing is dyed, using a liquor ratio of 1 : 10, the liquor being an aqueous solution of 4% Sulphur Green 3, 4 g/l of calcined sodium carbonate, 0.8 g/l of sodium bisulphide (100% strength), 10 g/l of calcined sodium sulphate and 0.4 g/l of dodecyl sulfonate wetting agent. The dyeing apparatus is charged with the yarn and the liquor, and the dyeing is carried out for about 10 minutes at 30° to 40° C, after which the liquor is heated to 90° C in the course of about 20 minutes and carrying out dyeing for 30 minutes at this temperature. The dyeing liquor is then cooled to about 30° to 40° C by running in cold water and is drained off, and the yarn is rinsed until clear by again running in cold water.

Subsequently, the oxidation is effected by treatment for 5 minutes at 90° C with a liquor containing 1.0% of hydroxylamine-O-sulphonic acid and subsequent hot and then cold rinsing. Oxidation treatment may be carried out with a liquor containing 1.0% of hydroxylamine-O-sulfonic acid and 3% of sodium carbonate at pH 9. Residual liquor is then removed by suction and the yarn is dried. A clear blue-green dyeing is obtained and the dyed fibers have excellent absorbency. The same oxidation effect is achieved by working at pH 10 with the addition of potassium carbonate.

EXAMPLE 3

A knit cotton fabric is dyed by the one-bath pad-steam method using 30 g/l of C.I. Vat Blue 43, 35 g/l of sodium hydroxide solution of 38° Be strength, 33 g/l of sodium dithionite and 1 g/l of an equimolar mixture of octyl and decyl sulphates. The fabric is impregnated with the above liquor at about 20° C and squeezed off ("padded") following which it is subjected to a treatment with saturated steam at about 105° C for 45 seconds, air being excluded. The fabric is then rinsed with cold water, sqeeezed off and treated at 60° C for 2 minutes with an aqueous 1.5% solution of hydroxylamine-O-sulphonic acid, is rinsed with hot, then cold water and dried.

The full blue of the sulfur vat dyestuffs is obtained but it is somewhat redder and has better fastness properties with respect to wet processing than is the case with other customary oxidizing agents. A similar result is obtained if, instead of the hydroxylamine-O-sulphonic acid, there is used the same amount of hydroxylamine-O,N-bis-sulphonic acid or of the protonated product formed by electrolytic reduction at a mercury cathode of a dilute aqueous solution of nitric and sulphuric acids according to the description given by Stscherbakow and Libina (Z. Elektrochem. 35, (1929) p. 70–83). This product has been given the formula $(HO_3SONH_3)_2SO_4$.

EXAMPLE 4

Using the pad-steam method, a dyeing on cotton cordury fabric is performed as follows: a wide web of the fabric is continuously moved through a cold padding liquor which is aqueous solution of 40 g/l C.I. Vat. Yellow 20 Colloisol and 1 g/l of sulphosuccinic acid diethyl ester to yield a liquor pick-up of 80%, then through squeeze-off rolls and a hot flue drier. Subsequently the fabric is impregnated with a liquor which is an aqueous solution of 60 ml/l sodium hydroxide solution of 38° Be strength, 40 g/l sodium dithionite and 20 g/l calcined sodium sulphate or sodium chloride, after which it is squeezed off (liquor pick-up 80 to 100%) and subjected, on the shortest possible path, to a steam treatment in the absence of air at 102° to 105° C for about 45 seconds. The steamed fabric is then introduced via a skying run into an open-width washing machine, in which a thorough rinsing with running cold water is first carried out and subsequently oxidation is effected in 2 boxes of the machine at 70° C using an aqueous solution of 2 g/l of hydroxylamine-O-sulphonic acid or of 5 g/l soda ash and 2 g/l hydroxylamine-O-sulfonic acid. Thereafter, the fabric is thoroughly rinsed and then treated in two or three compartments at the boil with an aqueous solution of sodium carbonate and 5 g/l sodium oleyl-methyltauride. Finally, it is again rinsed hot, then cold, and dried.

A full yellow with excellent fastness properties is obtained.

EXAMPLE 5

A well prepared absorbent woven fabric of pure Egyptian cotton is dyed, in accordance with the vat pad-steam method, by impregnating and squeezing off an aqueous solution of 50 g.l C.I.Vat Brown 17 Colloisol, 11 g/l sodium hydroxide solution of 38° Be strength and 80 g/l sodium dithionite up to a liquor pick-up of 80%, and then immediately subjected to a steam treatment, in the absence of air, at 102° to 103° for 45 seconds. The dyed fabric is then subjected to a skying run, after which it is rinsed in a washing machine and oxidized with 1.5 g.l of hydroxylamine-O-sulfonic acid at 60° C for 20 seconds. The same oxidation effect is achieved if the oxidizing liquor is adjusted to a pH of 8 by addition of 2 g/l of potassium carbonate. Finishing is effected by a fresh thorough rinsing and treatment at the boil with an aqueous solution of 2 g/l sodium carbonate and 5 g/l of sodium diisobutylnaphthalene sulfonate, followed by cold, then hot rinsing and dried.

The dyeing has a full, dark brown shade and possesses excellent fastness properties.

EXAMPLE 6

A skein of ready-to-dye cotton yarn is heated, in a yarn dyeing apparatus and using a liquor ratio of 1 : 12, to 50° to 90° C in the course of 20 minutes while immersed in an aqueous liquor of the following composition: 8.0% of Sulphur Black 1, 9.0 g/l of calcined sodium carbonate, 2.5 g/l of sodium bisulphide (100% strength), 20.0 g/l of sodium sulphate and 0.5 g/l of octyl phenyl sulphonate, the liquor being allowed to circulate through the yarn and the above temperature being then maintained for 30 minutes. The dye liquor is then cooled by adding cold water, drained, and the yarn then rinsed until clear in cold water.

Subsequently, the dyed yarn is oxidized by immersing it at 90° C for 5 minutes with a liquor which is a 2% aqueous solution of hydroxylamine-O-sulphonic acid adjusted to pH 10 with sodium carbonate. Residual liquor is then removed by suction and the yarn is rinsed with hot, then cold water and dried.

The oxidation may be performed without disadvantage in acid medium, the addition of sodium carbonate being omitted.

EXAMPLE 7

A pre-washed fabric made from regenerated cellulose is impregnated with a liquor containing 30 g/l C.I. Vat Yellow 33, immediately thereafter squeezed off to give a liquor pick-up of roughly 70% and subjected to a hot-air drying at 120° to 140° C. Subsequently, the fabric is impregnated with an aqueous solution consisting of 60 ml/l sodium hydroxide of 38° Be strength, 40 g/l sodium dithionite and 20 ml/l of the dyebath, squeezed off to give a liquor pick-up of some 100% and treated by saturated stream at 102° to 105° C for 40 minutes. The fabric is then allowed to run through a water seal at the end of the steamer (cold water trough), rinsed several times with cold water, squeezed off and treated with an aqueous solution of 2 g/l hydroxylamino-O-sulfonic acid at 60° to 70° C for 30 minutes. Thereupon it is rinsed hot and cold, washed at the boil with 1 to 2 g/l fatty alcohol sulfate, rinsed again with hot and cold water and dried.

Instead of oxidizing the fabric within the acid range it is possible to treat the material by the addition of 4 g/l sodium carbonate (calcined) at a pH 10 with the equal amount of hydroxylamine-O-sulfonic acid.

What is claimed:

1. In the oxidative after-treatment of fiber that has been dyed with a sulfur or vat dye to bring out the final dye shade and fastness, the improvement according to which the after-treatment is effected at a temperature between about 20° and about 105° C, with

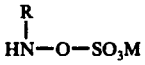

or a protonated product thereof,

R being hydrogen —$SO_3M$, and

M being hydrogen, ammonium, or a metal compatible with the after-treatment.

2. The improvement of claim 1 in which M is alkali metal or an alkaline earth metal.

3. The improvement of claim 1 in which M is sodium or potassium.

4. The improvement of claim 1 in which M is hydrogen.

5. The improvement of claim 1 in which the after-treatment is effected at a temperature between about 40° and about 90° C.

6. The improvement of claim in which the after-treatment of a textile dyed with a sulfur or sulfur-vat dye is effected by padding the dyed textile with an aqueous solution of the after-treating chemical and then steaming the padded textile.

* * * * *